US012357896B1

(12) United States Patent
Orchel

(10) Patent No.: US 12,357,896 B1
(45) Date of Patent: Jul. 15, 2025

(54) GOLF CLUB GRIPPING DEVICE

(71) Applicant: Thomas S. Orchel, Seekonk, MA (US)

(72) Inventor: Thomas S. Orchel, Seekonk, MA (US)

( * ) Notice: Subject to any disclaimer, the term of this patent is extended or adjusted under 35 U.S.C. 154(b) by 0 days.

(21) Appl. No.: 18/811,989

(22) Filed: Aug. 22, 2024

(51) Int. Cl.
*A63B 69/36* (2006.01)
*A63B 53/14* (2015.01)
*A63B 60/06* (2015.01)

(52) U.S. Cl.
CPC ..... *A63B 69/3608* (2013.01); *A63B 53/14* (2013.01); *A63B 60/06* (2015.10)

(58) Field of Classification Search
CPC ..... A63B 60/06; A63B 60/12; A63B 60/14; A63B 60/10; A63B 53/14; A63B 69/3608; A63B 71/0009
USPC ..... 473/201, 204, 205, 206
See application file for complete search history.

(56) References Cited

U.S. PATENT DOCUMENTS 1,322,027 A 11/1919 Lacaire
1,843,039 A 1/1932 Mohr
2,273,416 A * 2/1942 Norwood ..... A63B 69/0059 2/170
2,780,464 A * 2/1957 Ashley ..... A63B 60/10 473/206
2,928,678 A 3/1960 Cutting
2,962,288 A * 11/1960 Lowden ..... A63B 53/007 473/206
3,109,653 A 11/1963 Biggs
3,227,455 A * 1/1966 Hulsman ..... A63B 60/10 74/543
3,348,845 A * 10/1967 Stuart, Jr. ..... A63B 53/007 473/206
3,725,957 A 4/1973 Shotmeyer
4,357,717 A 11/1982 Puhl
5,116,057 A * 5/1992 Mangiaracina .... A63B 21/4021 473/409
5,180,165 A 1/1993 Frost
5,257,782 A * 11/1993 Schicketanz ..... A63B 60/10 473/551
5,704,845 A * 1/1998 Boyte ..... A63B 21/4019 473/205
6,152,831 A * 11/2000 Arcenas ..... A63B 53/14 473/409
6,350,206 B1 * 2/2002 Lambert, II ..... A63B 53/14 473/212
7,128,656 B1 * 10/2006 Orchel ..... A63B 60/10 473/205
9,566,496 B1 * 2/2017 Mallett ..... A63B 69/38
2006/0027614 A1 * 2/2006 Hall ..... A63B 60/08 224/220
2010/0145474 A1 * 6/2010 Duncan ..... A61F 4/00 623/57

(Continued)

*Primary Examiner* — John E Simms, Jr.
(74) *Attorney, Agent, or Firm* — Salter & Michaelson

(57) ABSTRACT

A device for gripping a shaft of a golf club or the like has a main support surface in the form of a thin walled member that extends in a crown between opposite one and another sides thereof and that defines a passage extending in a first direction for receiving the back side of a user's hand therein. A tubular member receives the shaft, has opposite one and another ends and is integrally formed with the thin walled member by means of one connection with one side of the thin walled member and another connection with another side of the thin walled member. The tubular member extends along a longitudinal axis that is angular to the aforementioned first direction.

20 Claims, 7 Drawing Sheets

(56) References Cited

U.S. PATENT DOCUMENTS

| | | | | |
|---|---|---|---|---|
| 2019/0022506 | A1* | 1/2019 | Walter | A63B 71/0009 |
| 2019/0289933 | A1* | 9/2019 | Kinsora | A01K 97/00 |
| 2020/0047042 | A1* | 2/2020 | Ianazone | A63B 69/3685 |

* cited by examiner

GOLF CLUB GRIPPING DEVICE

TECHNICAL FIELD

The present invention relates in general to a device for assisting in gripping a golf club or the like. The device of this invention can particularly assist a person having a medical condition such as arthritis or carpel tunnel syndrome. The device of the present invention can also function as a prosthesis, useful in holding a golf club or the like where the user has one or more missing fingers.

BACKGROUND OF THE INVENTION

In the prior art there do exist various types of aiding or gripping devices for use with sporting apparatus or other implements. Examples of these devices can be found in the following U.S. Pat. Nos. 1,843,039; 2,780,464; 2,962,288 and 5,704,845. A drawback to all these devices is that they do not effectively hold the implement shaft as well as effectively fit with the user's hand. Reference is also made to my U.S. Pat. No. 7,128,656 which discloses an improved gripping device. However, it has been found that the addition of a strap in a unique arrangement is advantageous.

Accordingly, it is an object of the present invention to provide an improved gripping device, particularly, but not exclusively, for use with a golf club.

Another object of the present invention is to provide an improved golf club gripping device that effectively holds the golf club shaft while at the same time fitting effectively with the user's hand so as to provide a gripping mechanism that enhances use of the club.

Still another object of the present invention is to provide an improved golf club gripping device that is particularly useful with a user having a medical condition such as arthritis or carpel tunnel syndrome.

A further object of the present invention is to provide an improved golf club gripping device that, not only functions as an improved device for holding the golf club in a comfortable position, but also functions as a prosthesis for a golfer having the loss of one or more fingers.

Still another object of the present invention is to provide an improved golf club gripping device that incorporates a securing strap.

Still another object of the present invention is to provide an improved golf club gripping device that adds a soft fabric on the inner surface to enhance the comfort of the user.

SUMMARY OF THE INVENTION

To accomplish the foregoing and other objects and advantages of the present invention there is provided a device for gripping a shaft of a golf club or the like, comprising a main support surface in the form of a thin walled member that extends in a crown between opposite one and another sides thereof and defining a passage extending in a first direction for receiving the back side of a user's hand therein, and a tubular member for receiving the shaft having opposite one and another ends and integrally formed with the thin walled member by means of one connection of one end with one side of the thin walled member and another connection of another end with another side of said thin walled member. The tubular member preferably extends along a longitudinal axis that is angular to said first direction.

In accordance with other aspects of the present invention, the tubular member defines a tubular passage that is tapered, the tubular member tapers from a larger diameter at said one end to a smaller diameter at said another end, the tubular member has an elongated slot that extends between its opposite ends, the elongated slot is longer than it is wide, the elongated slot has a width that is approximately half the diameter of the tubular member, the shaft has an intermediate section and a grasping section and the elongated slot is wide enough to readily receive the intermediate section of the shaft but narrow enough to retain the grasping section of the shaft, the device is preferably constructed of a hard plastic material, the one connection comprises a first bridge that extends at one end beyond the tubular member and at another end to about a midpoint along the tubular member, the another connection comprises a second bridge integrally formed between said thin walled member and tubular member, the first bridge is longer than the second bridge, both said one and another connections are integrally formed with the thin walled member and tubular member as a unitary piece, the second bridge has a thumb indentation and the thin walled member has a cut-out section adjacent said another connection for receiving the thumb of the user.

In accordance with another aspect of the present invention there is provided a device for gripping a shaft of a golf club or the like, comprising a main support surface in the form of a thin walled member that extends in a crown between opposite one and another sides thereof and defining a passage extending in a first direction for receiving the back side of a user's hand therein, a tubular member for receiving the shaft having opposite one and another ends and integrally formed with the thin walled member, a first bridge member for connection of one end of the tubular member with one side of the thin walled member and a second bridge member for connection of another end of the tubular member with another side of the thin walled member, both said first and second bridge members being integrally formed with the thin walled member and tubular member as a unitary piece.

In accordance with other aspects of the present invention the tubular member extends along a longitudinal axis that is angular to the first direction, the tubular member has a tubular passage therein and a longitudinally extending slot that extends between its opposite ends, the first bridge extends at one end beyond the tubular member and at another end to about a midpoint along the tubular member, the first bridge is longer than the second bridge, the second bridge has a thumb indentation and the thin walled member has a cut-out section adjacent the second bridge for receiving the thumb of the user.

In accordance with another aspect of the present invention there is provided a device for gripping a shaft of a golf club or the like, comprising a main support surface in the form of a thin walled member that extends in a crown between opposite one and another sides thereof and defining a passage extending in a first direction for receiving the back side of a user's hand therein, a tubular member for receiving the shaft having opposite one and another ends and integrally formed with the thin walled member by means of one connection of one end with one side of the thin walled member and another connection of another end with another side of the thin walled member, said tubular member extending along a longitudinal axis that is angular to the first direction, wherein the tubular member defines a tubular passage that is tapered, wherein the tubular member tapers from a larger diameter at said one end to a smaller diameter at said another end, wherein the tubular member has an elongated slot that extends between its opposite ends, wherein the elongated slot is longer than it is wide, wherein the one connection comprises a first bridge that extends at one end beyond the tubular member and at another end to about a midpoint along the tubular member, wherein the another connection comprises a second bridge integrally formed between the thin walled member and tubular member, wherein the first bridge is longer than the second bridge and wherein both said one and another connections are integrally formed with said thin walled member and tubular member as a unitary piece.

In accordance with the present invention there is also provided an elongated strap that has an inner end secured to an inner surface of the crown and an outer end that attaches to an outer surface of the crown. The tubular member defines a tubular passage, and the outer end of the elongated strap attaches by means of a hook and loop arrangement. The device may be constructed of a hard plastic material and the hook and loop arrangement may include a hook pad on the outer surface of the crown and a loop structure at the outer end of the strap. There may also be included a separate soft pad attached adjacent to the strap and on the inner surface of the crown. The soft pad and strap are glued to the inner surface of the crown.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

BRIEF DESCRIPTION OF DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE INVENTION

Figure 2:
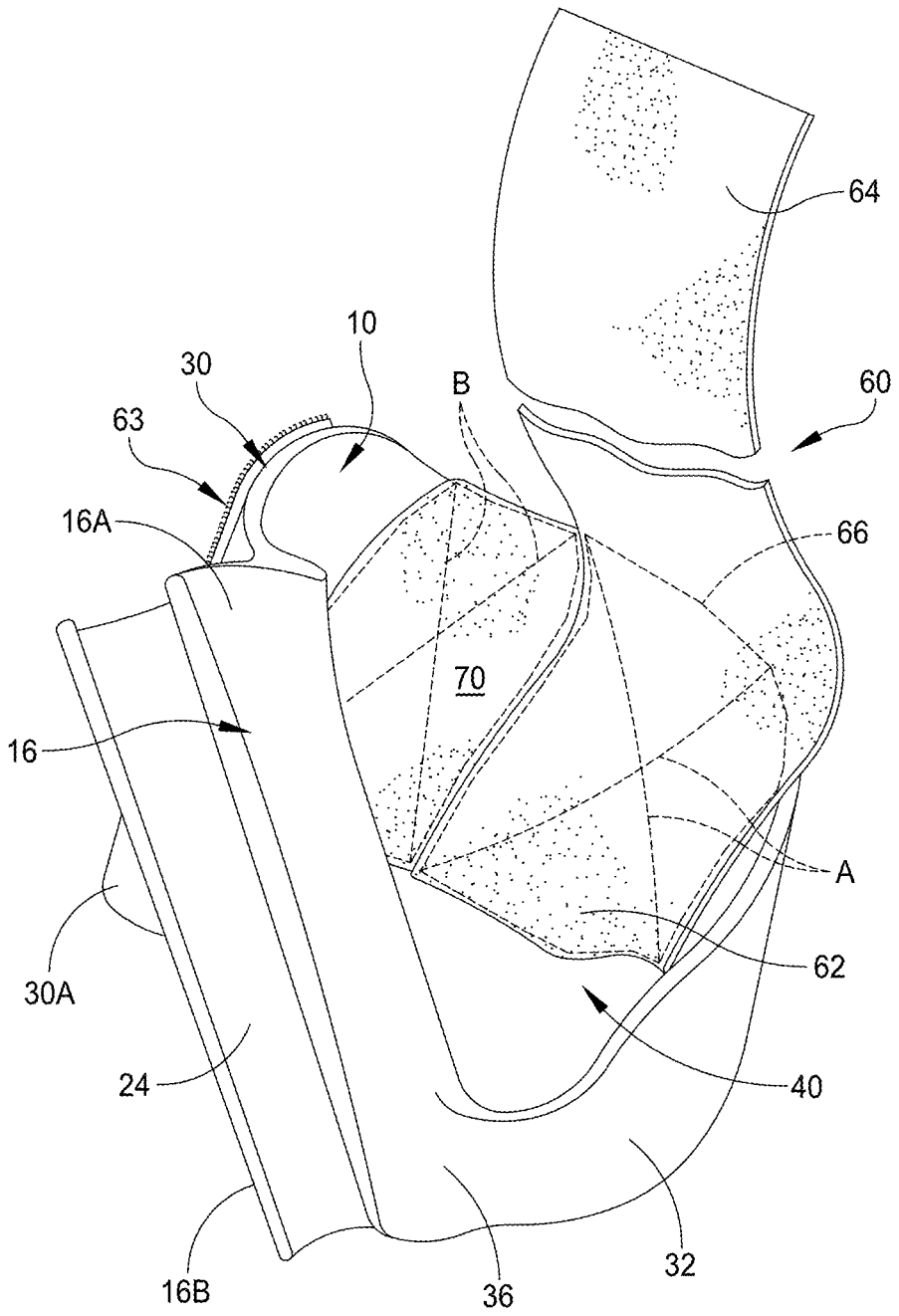
FIG. 2 is a perspective side view of the gripping device.
Figure 3:
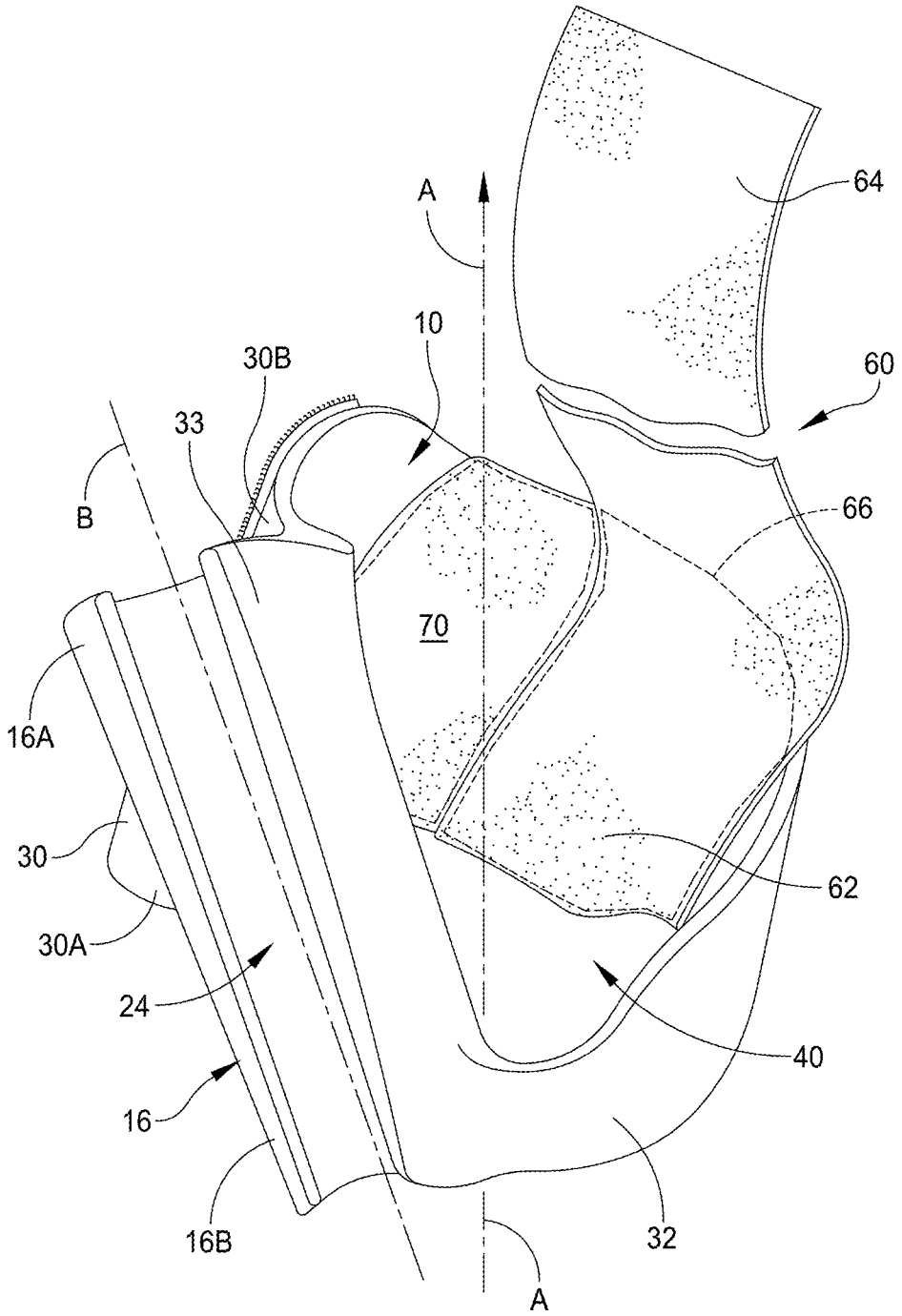
FIG. 3 is a perspective front view of the gripping device.
Figure 4:
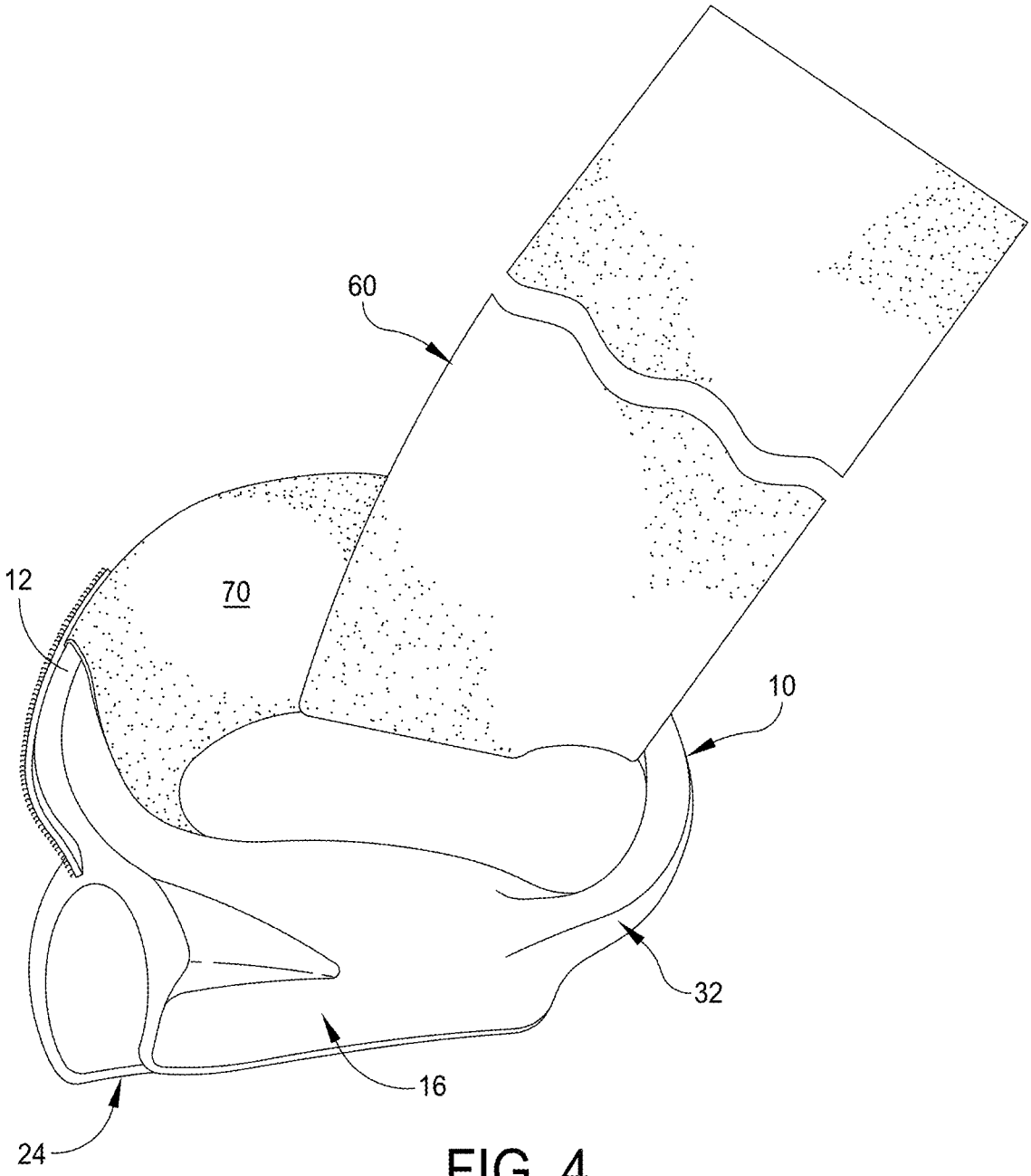
FIG. 4 is a perspective top view of the gripping device.
Figure 5:
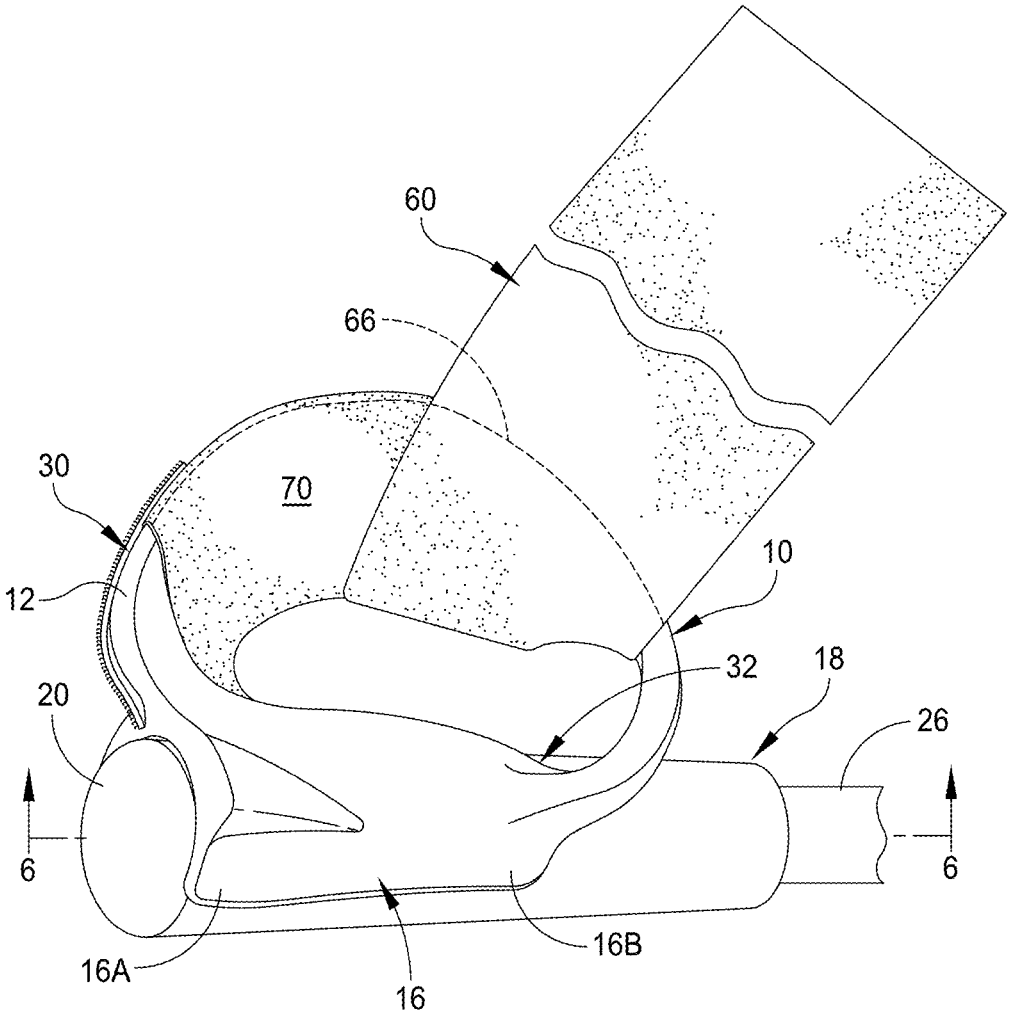
FIG. 5 is a perspective top view of the gripping device with the club shaft engaged.

Reference is now made to the preferred embodiment of the present invention as illustrated in FIGS. 1-7. The gripping device has a main support surface in the form of a thin-walled member that extends in a crown between opposite sides thereof. This is illustrated in the drawings by the thin-walled member 10. FIGS. 4 and 5 illustrate the crown at 12. The crown 12 is shaped to accommodate the backside of a user's hand and in the illustrated embodiment is for use with the left hand for a right-handed golfer. This thin-walled member defines a passage for the hand and extends generally in the direction of the longitudinal axis A illustrated in FIG. 3.

Figure 1:
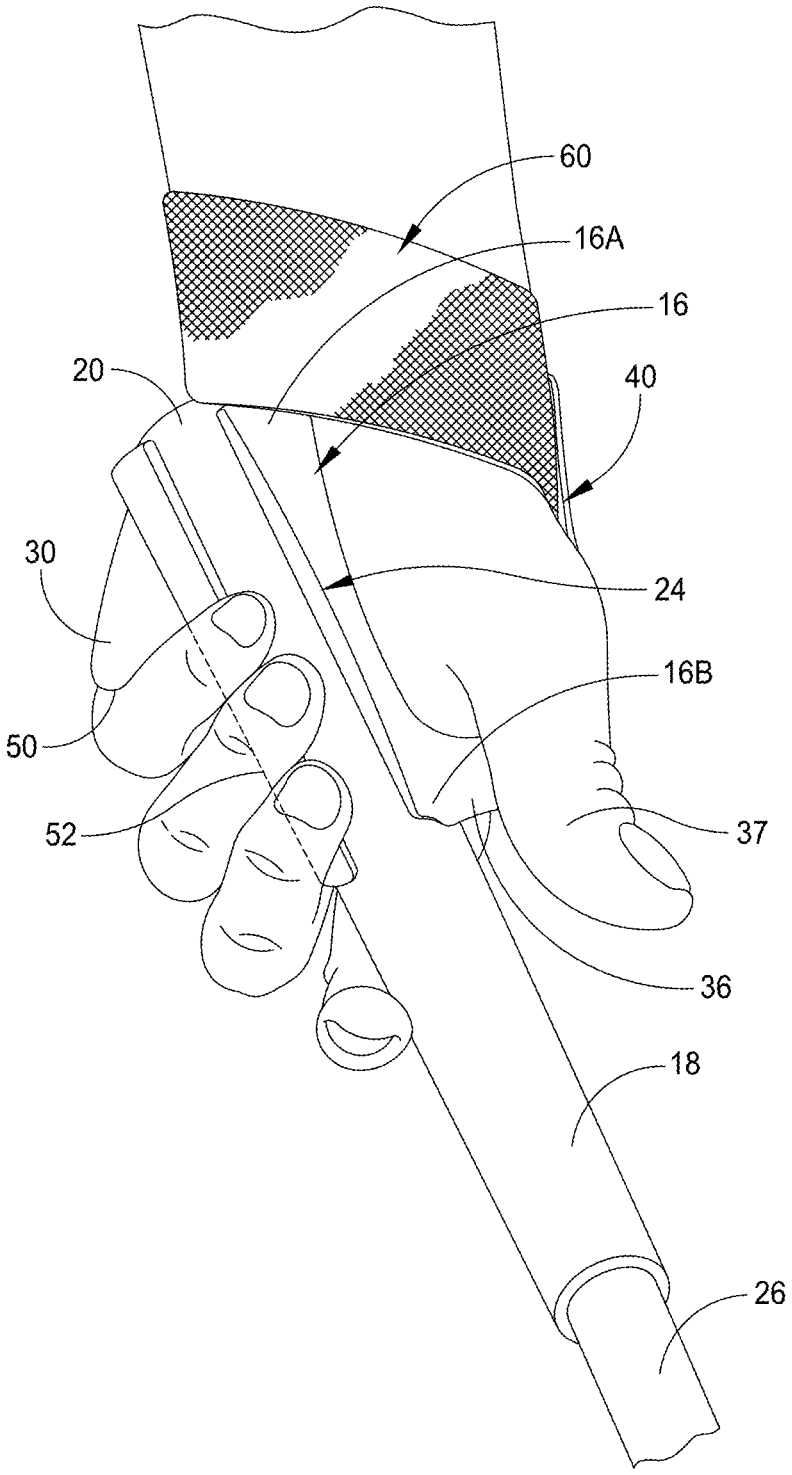
FIG. 1 is a perspective view showing the gripping device of the present invention with the user's hand inserted therein.

The gripping device of the present invention has formed integrally with the thin walled member 10, the tubular member 16. As illustrated in FIGS. 1 and 5, the tubular member 16 retains the golf club shaft 18 therein. The tubular member 16 is tapered from one end to the other. It has a generally larger diameter at end 16*a* than the diameter at end 16*b*. Similarly, the handle 20 of the golf club shaft is typically also tapered so that a snug fit occurs between the handle of the golf club shaft and the tubular member. Actually, it is primarily the passage in the tubular member that is tapered as that is what makes contact with the club.

Figure 6:
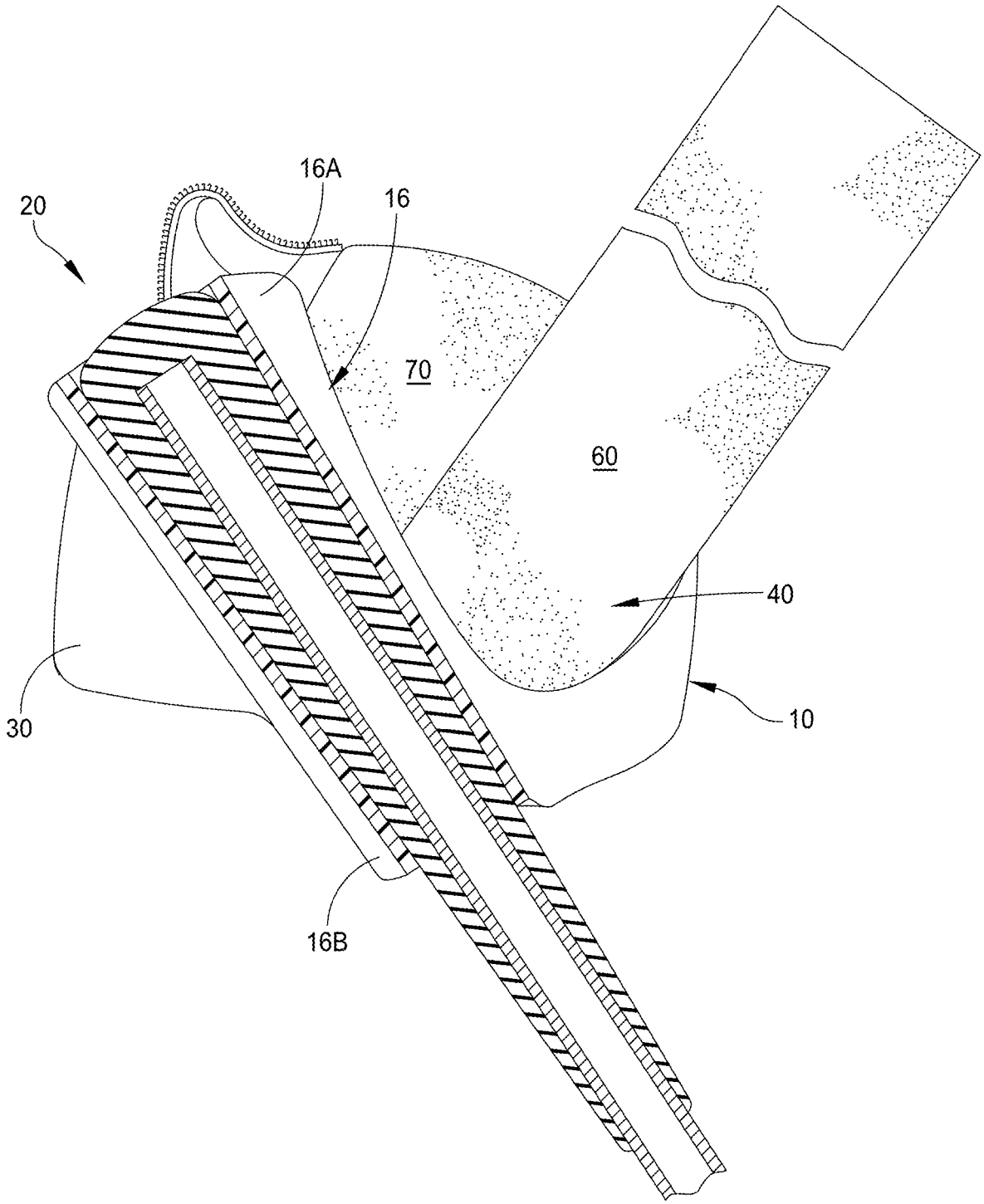
FIG. 6 is a cross-sectional view of the gripping device as taken along line 6-6 of FIG. 5.

The golf club shaft is generally inserted through the elongated slot 24. The elongated slot 24 is substantially longer than its width and has a width that is approximately half the main diameter of the tubular member. The slot 24 has a width that is wider than the diameter of the main shaft portion 26 of the golf club shaft. In this way the golf club can be mated with the gripping device by engaging the shaft 26 through the slot 24 and then moving the club downwardly to the position illustrated in FIGS. 1 and 5. FIG. 6 also illustrates by a cross sectional view the two ends of the tubular member 16 and the handle end 20 of the golf club firmly in place with the taper of the handle essentially matching that of the taper of the internal passage of the tubular member.

The tubular member 16 may be considered as integrally formed with the thin-walled member 10 by means of a first connection or bridge 30 for connection of one end of the tubular member with one side of the thin-walled member. A second connection or bridge 32 is also provided for integrally connecting the other end of the tubular member with the opposite side of the thin-walled member. As illustrated in FIG. 3, the tubular member 16 extends along a generally longitudinal axis B that is angular to the aforementioned axis A. The angle therebetween may be on the order of 30° or in a range of 15-45°. This provides the proper orientation of the hand with the club shaft.

The connection bridge 30, as is illustrated in FIG. 3, has one end 30*a* that extends about from the mid-point along the tubular member 16, and another end 30*b* that extends slightly beyond the larger diameter end of the tubular member 16. The other bridge or connection area 32 is integrally formed between the thin-walled member and the tubular member and is at the opposite or smaller diameter end of the tubular member 16. At the larger diameter end of the tubular member 16, the tubular member preferably flairs slightly away from the longitudinal axis as illustrated at 33 in FIG. 3. This provides a more comfortable fit of the gripping device with the palm of the user. Refer also to the flared configuration 33 in FIG. 5.

Another feature of the gripping device of the present invention is the provision of a slight thumb indentation at 36. FIG. 1 shows this indentation and the associated thumb 37 adjacent thereto.

Still another feature of the present invention is the preferred cutout 40 that provides an area for accommodation of the thumb 37. FIG. 1 illustrates the thumb 37 in placement in the cutout section 40. FIG. 2 illustrates this cutout section 40 without the thumb in place.

The device of the present invention can be constructed using a number of different types of materials, as well as different forming or molding processes. For example, the device can be made of a hard plastic, of fiberglass or other composites such as ones using a carbon fiber. It is preferred that the device be made of a relatively light-weight material so as to not be cumbersome in its usage. The device can be made by an injection molding process. The device can be made in a unitary structure or can be made from two or more parts that are bonded or fastened together. The device can be readily formed in different sizes for use by adults and children.

FIG. 1 illustrates the gripping device in its fully engaged position with the user hand. In this position the smallest finger may engage at surface 50 (of bridge 30) as it is wrapped around the tubular member. The ring and middle fingers may engage surface 52 (of tubular member 16). The index finger may be free to engage the club shaft and the thumb may rest in the indentation 36. The thumb may also slightly extend to engage the club shaft. The cut-out section 40 enables this positioning.

When the device functions as a prosthetic the integrated nature of the device enables an effective fit with the hand even if one or more of the user's fingers are missing. The snug fit between the tubular member and crown assists in holding the device in place even when the user has one or more missing fingers. The thumb in the indentation 40 also assists in keeping the device in place under those circumstances. The tapered nature of the tubular holder makes for a snug and comfortable fit of the club with the device.

Figure 7:
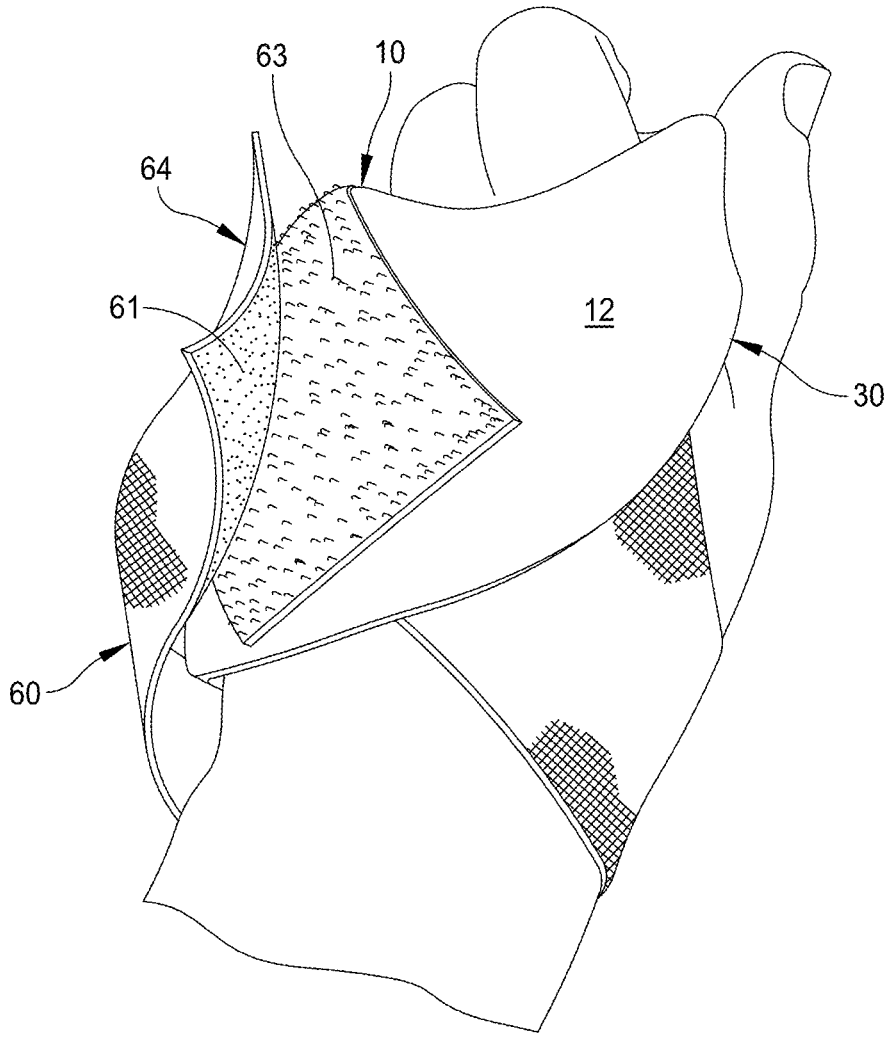
FIG. 7 is a top perspective view illustrating the strap secured in place.

In accordance with the present invention there is also provided an elongated strap 60 that has an inner end 62 secured to an inner surface of the crown and an outer end that attaches to an outer surface of the crown 12. The tubular member 16 defines a tubular passage, and the outer end 64 of the elongated strap 60 attaches by means of a hook and loop arrangement. Refer to FIGS. 2, 3 and 7 for more details. The device may be constructed of a hard plastic material and the hook and loop arrangement may include a hook pad 63 (see FIG. 7) on the outer surface of the crown 12 and a loop structure 61 at the inner surface of the strap 60. There may also be included a separate soft pad 70 (see FIGS. 2-4) attached adjacent to the strap 60 and on the inner surface of the crown 12.

The soft pad 70 and the strap 60 are glued to the inner surface of the crown 12. As illustrated in, for example, FIG. 2 the entire area "A" of the inner end 62 of the strap 60 may be glued to the inner surface of the crown 12. Both the pad 70 and the strap 60 are formed of a soft material including a "loop" structure that both functions as a soft material and as a means for securing the strap in place. Note also that the area "A" of the strap 60 and the area "B" of the pad 70 extend about the full width of the inner surface of the crown. Both areas "A" and "B" provide a soft contact with the back side of the hand when the device is in use, such as illustrate in FIG. 1. Refer also to the top perspective view of FIG. 7 which shows the hook pad 63, that is attached to an outer surface of the crown 12, being engaged with the outer free end 64 of the strap 60. The areas "A" and "B" may be glued along their entire surface with the inner surface of the crown 12; of the strap 60 may be glued only along the line 66 to the crown 12. While the description herein relates to a device for holding a golf club, it is noted that the device is particularly effective with a golfer having sweaty hands.

While this disclosure has been particularly shown and described with references to preferred embodiments thereof, it will be understood by those skilled in the art that various changes in form and details may be made therein without departing from the spirit and scope of the disclosure as defined by the appended claims.

The invention claimed is:

1. A device for gripping a shaft of a club, comprising a main support surface in the form of a thin-walled member that extends in a crown between opposite one and another sides thereof and defining a passage extending in a first direction and dimensioned sufficiently to receive the back side of a user's hand therein, a hard material tubular member for receiving said shaft having opposite one and another ends and integrally formed with the thin walled member by means of one connection of said one end with said one side of the thin walled member and another connection of said another end with said another side of said thin walled member, said tubular member extending along a longitudinal axis that is angular to said first direction; wherein said one connection comprises a first bridge that accommodates one side of the hand; wherein said another connection comprises a second bridge that accommodates an opposite side of the hand; an elongated strap that has an inner end secured to an inner surface of the thin-walled member and an outer end that attaches to an outer surface of the thin-walled member, wherein both said one and another connections are integrally formed with said thin walled member and tubular member; and a soft pad attached adjacent to the strap and on the inner surface of the crown of the thin-walled member, the soft pad abutting the strap along a length of the strap leaving no gap therebetween, wherein a first area of the strap extends about a full width of the inner surface of the crown of the thin-walled member, wherein a second area of the soft pad extends about the full width of the inner surface of the crown of the thin-walled member, and wherein the first and second areas provide a soft contact with the back side of the hand when the device is in use.

2. The device of claim 1 wherein said tubular member defines a tubular passage and the outer end of the elongated strap attaches by means of a hook and loop arrangement.

3. The device of claim 2 wherein the tubular member passage tapers from a larger diameter at said one end to a smaller diameter at said another end.

4. The device of claim 1 wherein the tubular member has an elongated slot that extends between its opposite ends, and wherein said second bridge defines, with said tubular member and crown, a cut-out section this is deeper than the width of said second bridge so as to accommodate the thumb of the user.

5. The device of claim 4 wherein said elongated slot is longer than it is wide.

6. The device of claim 5 wherein said elongated slot has a width that is approximately half the diameter of the tubular member and has an angular direction that is in a range of 15-45 degrees.

7. The device of claim 4 wherein said elongated slot is wide enough to readily receive an intermediate section of the shaft but narrow enough to retain a grasping section of the shaft.

8. The device of claim 2 wherein the device is constructed of a hard plastic material and the hook and loop arrangement includes a hook pad on the outer surface of the crown and a loop structure at the outer end of the strap.

9. The device of claim 2 including a soft pad attached adjacent to the strap and on the inner surface of the crown, the soft pad abutting the strap along a length of the strap leaving no gap therebetween.

10. A device for gripping a shaft of a club, comprising a main support surface in the form of a member that extends in a crown between opposite one and another sides thereof and defining a passage extending in a first direction for receiving the back side of a user's hand therein, a tubular member for receiving said shaft having opposite one and another ends and integrally formed with a thin walled member by means of one connection of said one end with said one side of the thin walled member and another connection of said another end with said another side of said thin walled member, said tubular member extending along a longitudinal axis that is angular to said first direction; wherein said one connection comprises a first bridge that extends at one portion thereof beyond the tubular member and at another portion thereof to about a midpoint along the tubular member; wherein said another connection comprises a second bridge member integrally formed between said thin walled member and tubular member; and an elongated strap that has an inner end secured to an inner surface of the crown of the thin walled member and an outer end that attaches to an outer surface of the crown of the thin walled member, wherein both said one and another connections are integrally formed with said thin walled member and tubular member piece, and a soft pad attached adjacent to the strap and on the inner surface of the crown of the thin walled member, the soft pad abutting the strap along a length of the strap leaving no gap therebetween, wherein a first area of the strap extends about a full width of the inner surface of the crown of the thin walled member, wherein a second area of the soft pad extends about the full width of the inner surface of the crown of the thin walled member, and wherein the first and second areas provide a soft contact with the back side of the hand when the device is in use.

11. The device of claim 10, wherein the first bridge is longer than the second bridge an further including a soft pad attached adjacent to the strap and on the inner surface of the crown, the soft pad and strap being glued to the inner surface of the crown.

12. The device of claim 10 wherein said second bridge has a thumb indentation.

13. The device of claim 10 wherein said thin-walled member has a cut-out section adjacent said another connection for receiving the thumb of the user.

14. The device of claim 10 wherein said tubular member defines a tubular passage and the outer end of the elongated strap attaches by means of a hook and loop arrangement.

15. The device of claim 14 wherein the hook and loop arrangement includes a hook pad on the outer surface of the crown and a loop structure at the outer end of the strap.

16. The device of claim 15 including a soft pad attached adjacent to the strap and on the inner surface of the crown, the soft pad and strap being glued to the inner surface of the crown.

17. A device for gripping a shaft of a of club, comprising a main support surface in the form of a thin walled member that extends in a crown between opposite one and another sides thereof and defining a passage extending in a first direction for receiving the back side of a user's hand therein, a tubular member for receiving said shaft having opposite one and another ends and integrally formed with the thin walled member, a first bridge member for connection of said one end of said tubular member with said one side of the thin walled member and a second bridge member for connection of said another end of said tubular member with said another side of said thin walled member, both said first and second bridge members being integrally formed with said thin walled member and tubular member, and an elongated strap that has an inner end secured to an inner surface of the crown of the thin walled member and an outer end that attaches to an outer surface of the crown of the thin walled member, and including a soft pad attached adjacent to the strap and on the inner surface of the crown of the thin walled member, the soft pad abutting the strap along a length of the strap leaving no gap therebetween, wherein a first area of the strap extends about a full width of the inner surface of the crown of the thin walled member, wherein a second area of the soft pad extends about the full width of the inner surface of the crown of the thin walled member, and wherein the first and second areas provide a soft contact with the back side of the hand when the device is in use.

18. The device of claim 17 wherein said tubular member extending along a longitudinal axis that is angular to said first direction and said second bridge member being shorter than said first bridge member so as to define a cut-out section for receiving the thumb of the user.

19. The device of claim 17 wherein said tubular member defines a tubular passage and the outer end of the elongated strap attaches by means of a hook and loop arrangement.

20. The device of claim 17 wherein the device is removably attached to the shaft of the club.

* * * * *